US012146329B2

(12) United States Patent
Lopez

(10) Patent No.: US 12,146,329 B2
(45) Date of Patent: Nov. 19, 2024

(54) SHORING APPARATUS, SYSTEM, AND RELATED METHOD FOR CONCRETE EDGE REPAIRS

(71) Applicant: NATIONAL CONCRETE PRESERVATION, INC., Miami, FL (US)

(72) Inventor: Eddie Lopez, Miami, FL (US)

(73) Assignee: National Concrete Preservation, Inc., Miami, FL (US)

( * ) Notice: Subject to any disclaimer, the term of this patent is extended or adjusted under 35 U.S.C. 154(b) by 213 days.

(21) Appl. No.: 17/526,804

(22) Filed: Nov. 15, 2021

(65) Prior Publication Data

US 2022/0154482 A1 May 19, 2022

Related U.S. Application Data

(60) Provisional application No. 63/113,385, filed on Nov. 13, 2020.

(51) Int. Cl.

| | |
|---|---|
| ***E04G 25/02*** | (2006.01) |
| ***E04G 7/30*** | (2006.01) |
| ***E04G 7/32*** | (2006.01) |
| ***E04G 7/34*** | (2006.01) |
| ***E04G 11/48*** | (2006.01) |
| *E04G 25/00* | (2006.01) |

(52) U.S. Cl.

CPC ..... *E04G 25/02* (2013.01); *E04G 7/307* (2013.01); *E04G 7/308* (2013.01); *E04G 7/32* (2013.01); *E04G 7/34* (2013.01); *E04G 11/48* (2013.01); *E04G 2025/006* (2013.01)

(58) Field of Classification Search

CPC ..... E04G 11/48; E04G 13/06; E04G 13/066; E04G 23/0292; E04G 25/02; E04G 2025/006

See application file for complete search history.

(56) References Cited

U.S. PATENT DOCUMENTS 3,172,634 A * 3/1965 Squire ..... E04G 13/06 248/354.3
4,450,121 A * 5/1984 Bequette ..... E04G 3/20 249/48

(Continued)

FOREIGN PATENT DOCUMENTS

DE 3815338 A * 11/1989 ..... B25B 5/08
DE 29606111 U1 * 7/1997 ..... E01D 21/00

(Continued)

*Primary Examiner* — Brian E Glessner
*Assistant Examiner* — Daniel J Kenny
(74) *Attorney, Agent, or Firm* — Roberto M. Suarez, Esq.

(57) ABSTRACT

The present invention discloses a shoring apparatus, a system incorporating the apparatus, and a related method utilizing the apparatus in the system for an improvement in conducting concrete edge repairs in multi-story buildings. The shoring apparatus includes a structural member and attachment features that are configured to make the shoring apparatus attachable to the underside of a concrete structure that is to undergo edge repairs. The shoring apparatus is advantageous over shore poles in that they securely support the concrete form without relying on a lower structure to counter the load of the structural repair.

1 Claim, 8 Drawing Sheets

(56) References Cited

U.S. PATENT DOCUMENTS

| | | | | | |
|---|---|---|---|---|---|
| 4,846,433 | A * | 7/1989 | Courtois | E04G 17/18 | 249/23 |
| 5,544,851 | A * | 8/1996 | Moore | F16M 13/02 | 248/544 |
| 5,755,981 | A * | 5/1998 | Payne | E04G 13/066 | 249/23 |
| 6,098,552 | A * | 8/2000 | Gunderson | A47B 57/567 | 211/187 |
| 7,360,627 | B2 * | 4/2008 | Scott | A47B 96/061 | 182/150 |
| D671,821 | S * | 12/2012 | Anzelmo | D8/380 | |
| 9,601,036 | B2 * | 3/2017 | Barnard, IV | G09F 19/226 | |
| 2002/0095892 | A1 * | 7/2002 | Johnson | E02D 27/32 | 52/294 |

FOREIGN PATENT DOCUMENTS

| | | | | |
|---|---|---|---|---|
| DE | 102009014858 | A1 * | 10/2010 | E01D 19/106 |
| WO | WO-2008132277 | A1 * | 11/2008 | E01D 19/106 |
| WO | WO-2009125070 | A1 * | 10/2009 | E01D 22/00 |
| WO | WO-2018049481 | A1 * | 3/2018 | E04G 13/06 |

* cited by examiner

100

SHORING APPARATUS, SYSTEM, AND RELATED METHOD FOR CONCRETE EDGE REPAIRS

CROSS-REFERENCE TO RELATED APPLICATIONS

This application is a non-provisional of, and claims priority to, U.S. patent application Ser. No. 63/113,385, titled "SHORING APPARATUS, SYSTEM, AND RELATED METHOD FOR CONCRETE EDGE REPAIRS," filed on Nov. 13, 2020; which application is incorporated by reference herein in its entirety.

FIELD OF THE INVENTION

The present invention generally relates to construction equipment and more specifically relates to a shoring apparatus, a system incorporating the apparatus, and a related method utilizing the apparatus in the system for an improvement in conducting concrete edge repairs in multi-story buildings.

BACKGROUND OF THE INVENTION

Concrete edge repairs for structures, inter alia, concrete balconies, is a difficult undertaking and requires the use of multiple pole shores supporting a mold or form (typically made of wood). An example of a balcony edge repair illustrating the use of pole shores is shown in FIG. 1. These pole shores 10 hold up the form 20 to the bottom of the balcony 30 and must be supported by firm footing 40 to be structurally sound. The use of pole shores is time-consuming since each pole shore must be individually adjusted to the precise position in order to support the frame and/or mold. The use of pole shores is difficult, or just not feasible, when there is no solid flooring to stand them on. The use of pole shores means that, in multi-story buildings, as seen in FIG. 1 for example, only one balcony at a time can be done—and then only every other balcony can be done at a time, since the pole shores require the previous (lower) balcony to be a structural support. The use of pole shores becomes impractical, if not impossible, to use in buildings where the architecture is unique, curved, overhanging, or otherwise not "one balcony over the other."

Additionally, since the pole shores, by definition, only support the underside of the form at a single point of contact—at the top of the pole—the forms themselves need to be more complex and include additional structure in order to support the new concrete cantilevered at a distance away from where the pole shore is supporting the form.

There is currently no satisfactory apparatus in the market that is designed to shore up (support) a form and balcony that is undergoing structural repairs that does not require or implicate the use of a previous (lower) balcony for support. There is also no satisfactory apparatus in the market that is designed to support the cantilevered portion of the form without complicating or adding structure to the form itself.

There exists, therefore, a need for an apparatus, as well as a related system and method, that does not suffer from the aforementioned problems.

SUMMARY OF THE INVENTION

The present invention advantageously fills the aforementioned deficiencies by providing a shoring apparatus, a system incorporating the apparatus, and a related method utilizing the apparatus in the system for an improvement in conducting concrete edge repairs in multi-story buildings.

Briefly, according to an embodiment, the invention includes a shoring apparatus with structures configured to attach the apparatus directly to the underside of a balcony structure in order to provide the support for the form (in embodiments, for example, a flat plywood sheet) not only at the point of attachment, but also cantilevered out towards or past the edge of the balcony away from the point of attachment.

Embodiments of the apparatus include a structural main member having one or more attachment locations that are configured so that the apparatus can be bolted to the structure to be repaired, such as with wedge bolts. The attachment locations on the structure are typically at a significant distance "in"—or away—from the outer edge of the structure. In order to accommodate the form all the way out to the outer edge, the main member of the apparatus extends distally from the one or more attachment locations, cantilevered therefrom.

The bottom "form" for the repair can just be plywood sheets as the load from the new concrete is transferred to, and held up by, the apparatus.

A system according to an embodiment includes one or more apparatus that is securable to a balcony structure via a removable fastener (such as wedge bolts), a one or more plywood (or similar) form that is securable to a balcony structure with removable fasteners (such as self-tapping concrete screws—TAPCON® or similar), and a one or more spacer beam configurable to span the one or more apparatus and support the space between the apparatus and the plywood.

A method according to an embodiment of the invention includes the steps of: providing a one or more shoring apparatus as disclosed herein; attaching the one or more shoring apparatus to the underside of a structure to be repaired with each apparatus substantially perpendicular to the edge to be repaired; attaching plywood to the underside of the structure to be repaired to form a bottom support for the new concrete; inserting a spacer beam supported between each shoring apparatus and the plywood such that a load on the plywood is transferred into the apparatus, whereby a balcony concrete edge repair can be performed.

It is therefore an object of the present invention to "shore up"—support—a mold or form for concrete edge repairs without the need to have a lower structure (a lower balcony or floor) to support the shoring apparatus.

It is another object of the present invention to provide a shoring apparatus and other components that work in concert—in a system—in order to enable edge repairs of a concrete structure without the need to have a lower structure (a lower balcony or floor) to support the shoring apparatus or other system components.

It is still a further object of the present invention to provide a method of utilizing the shoring apparatus and system whereby edge repairs of a concrete structure without the need to have a lower structure (a lower balcony or floor) to support the shoring apparatus or other system components is enabled.

The present invention now will be described more fully hereinafter with reference to the accompanying drawings, which are intended to be read in conjunction with both this summary, the detailed description and any preferred and/or particular embodiments specifically discussed or otherwise disclosed, as well as, the appended claims. This invention may, however, be embodied in many different forms and should not be construed as limited to the embodiments set forth herein; rather, these embodiments are provided by way-of illustration only and so that this disclosure will be thorough, complete and will fully convey the full scope of the invention to those skilled in the art.

BRIEF DESCRIPTION OF THE DRAWINGS

In the accompanying figures, like reference numerals refer to identical or functionally similar elements throughout the separate views. The accompanying figures, together with the detailed description below are incorporated in and form part of the specification and serve to further illustrate various embodiments and to explain various principles and advantages all in accordance with the present invention, in which.

Figure 1:
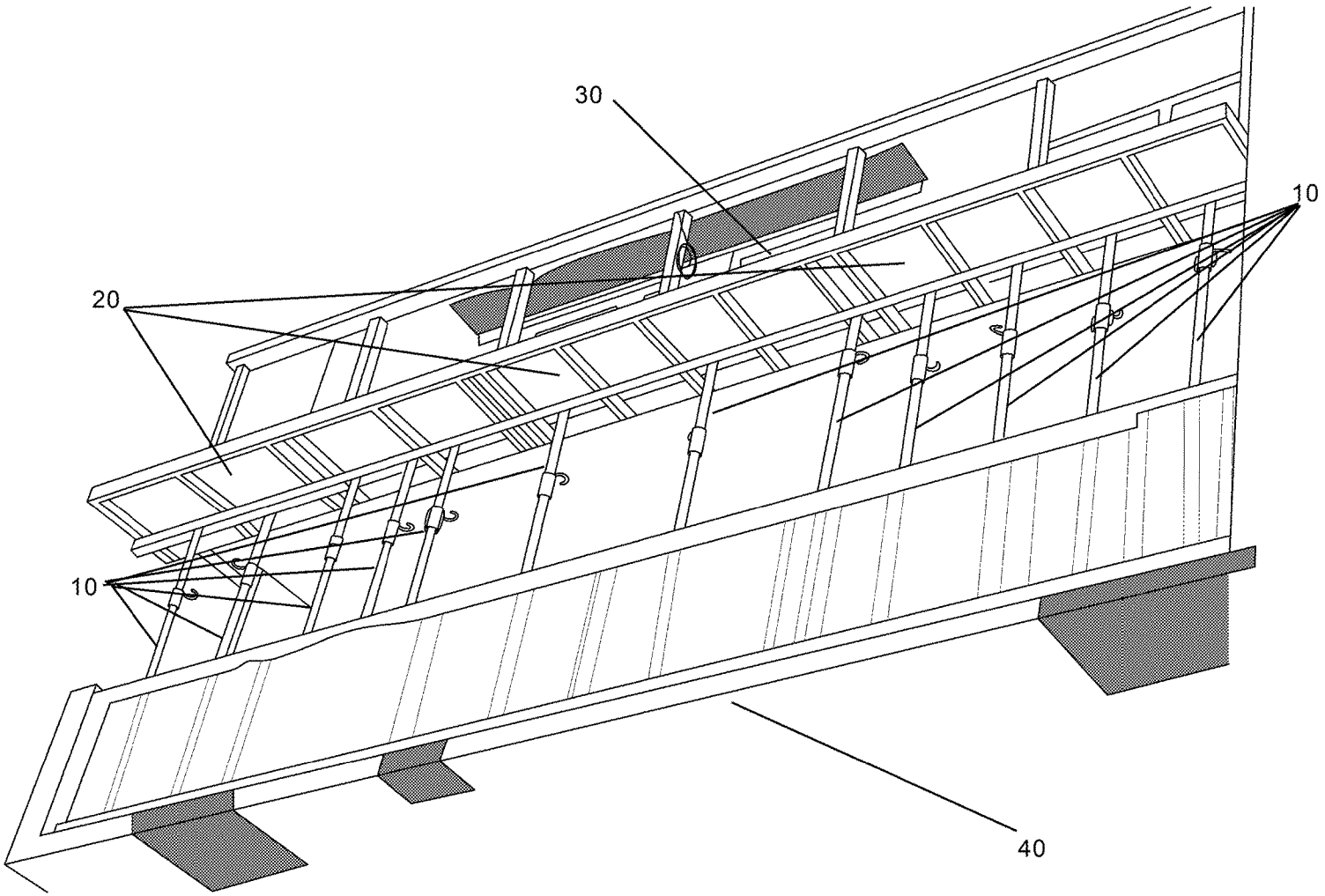
FIG. 1 is a pictorial representation of an edge repair on a concrete balcony utilizing pole shores.

While the invention as claimed can be modified into alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the scope of the present invention.

DETAILED DESCRIPTION

In a preferred embodiment, we disclose a shoring apparatus, a system incorporating the apparatus, and a related method utilizing the apparatus in the system for an improvement in conducting concrete edge repairs in multi-story buildings.

The Apparatus 100

Figure 2:
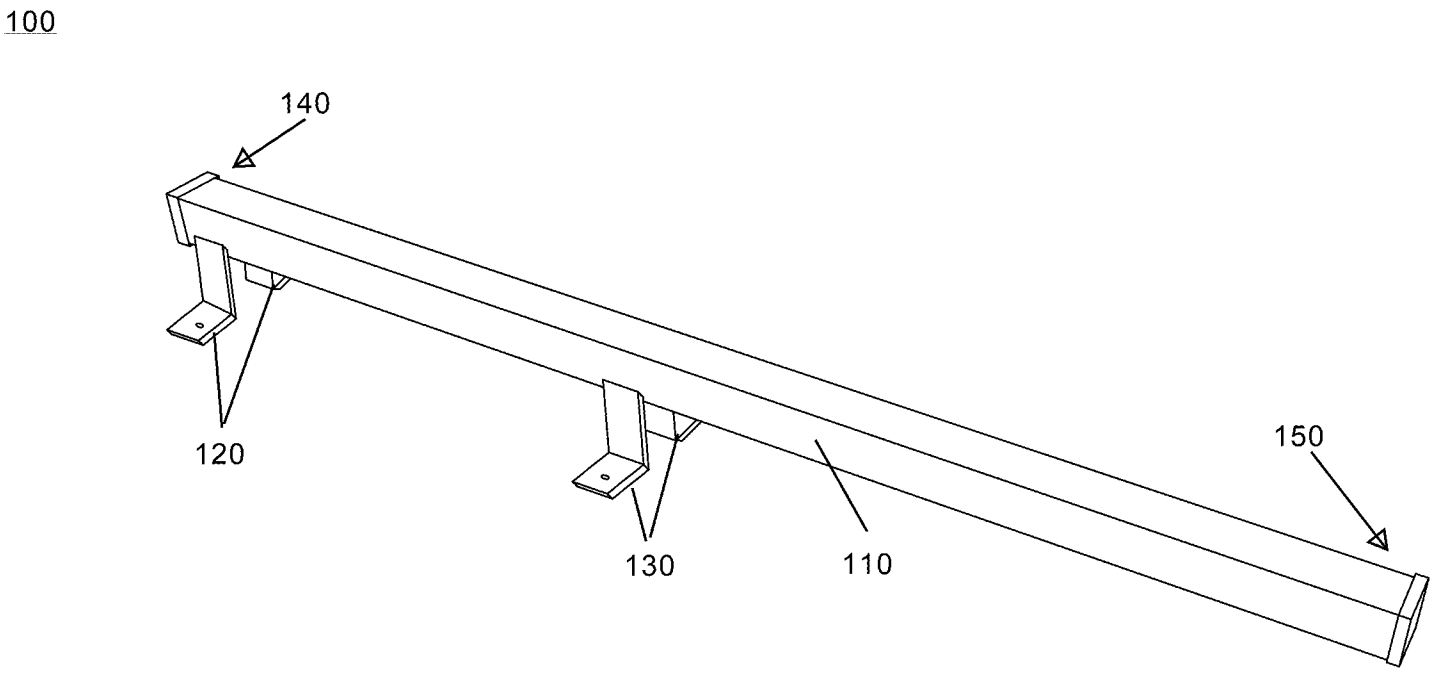
FIG. 2 is an isometric view of a shoring apparatus, according to an embodiment.
Figure 3:
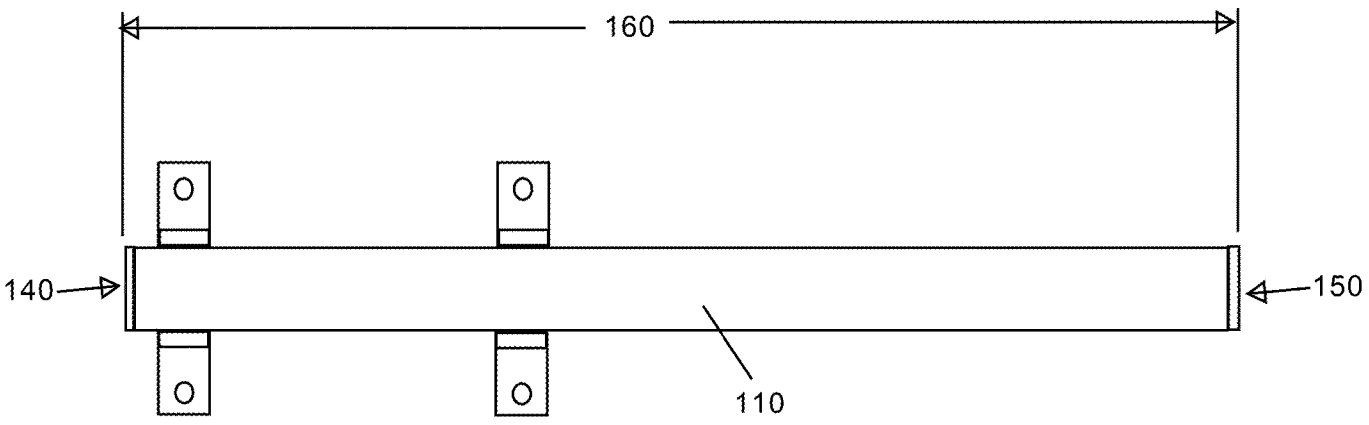
FIG. 3 is a top view of the shoring apparatus shown in FIG. 2.
Figure 4:
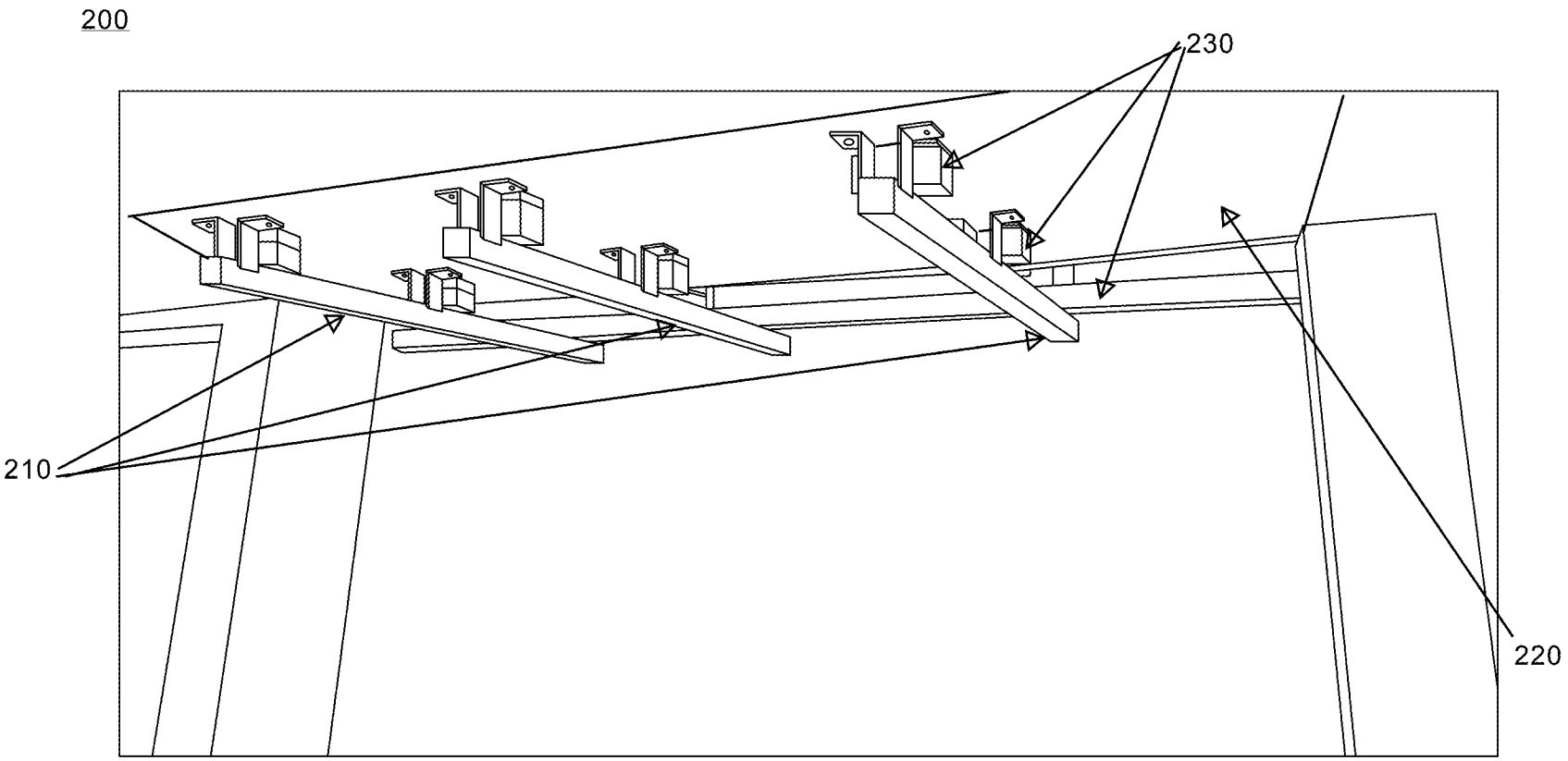
FIG. 4 is a pictorial representation of a system utilizing the shoring apparatus in a concrete edge repair, looking out towards the edge to be repaired, according to an embodiment.
Figure 5:
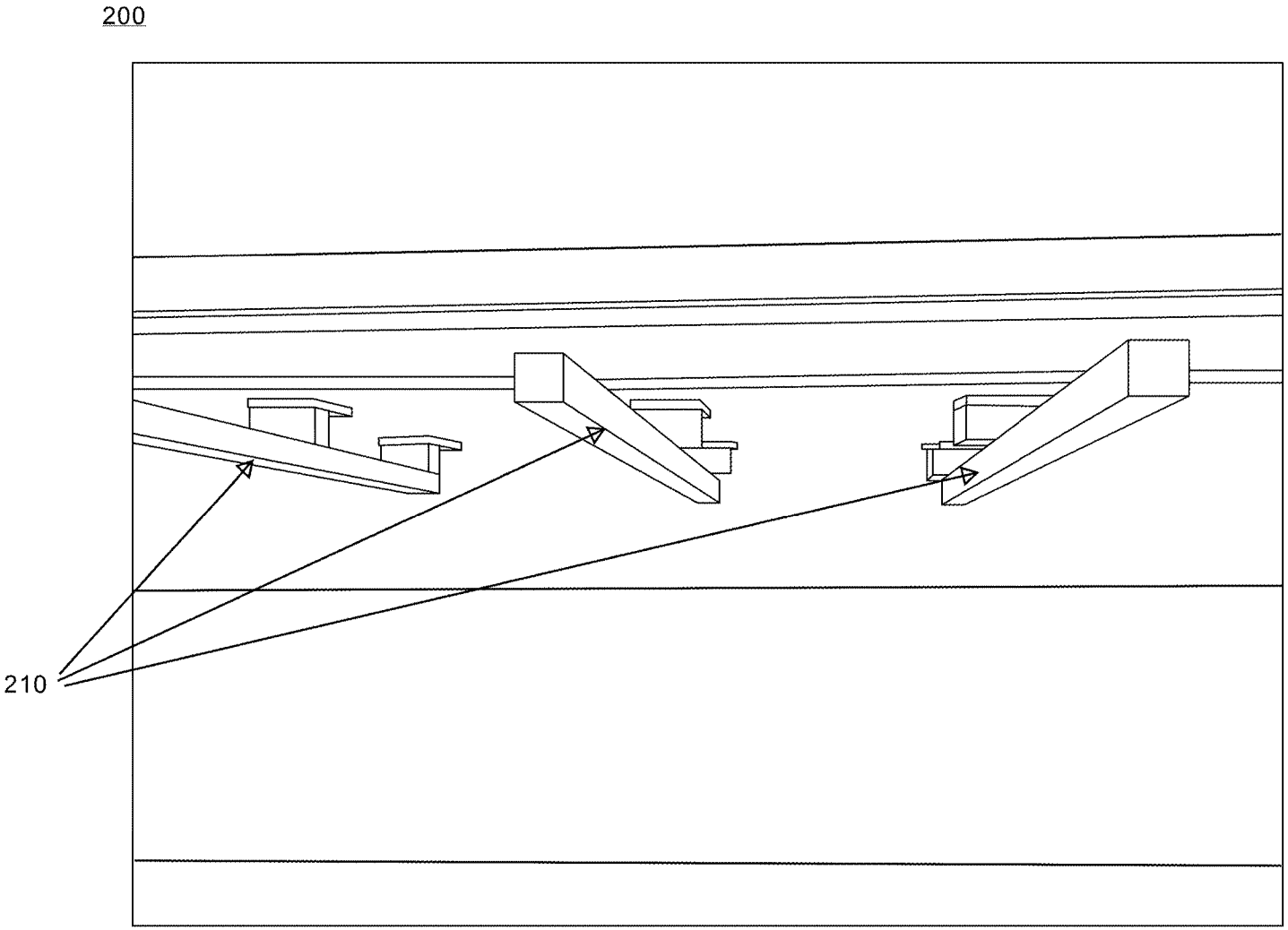
FIG. 5 is another perspective view of the system depicted in FIG. 4, looking in toward the edge to be repaired.
Figure 6:
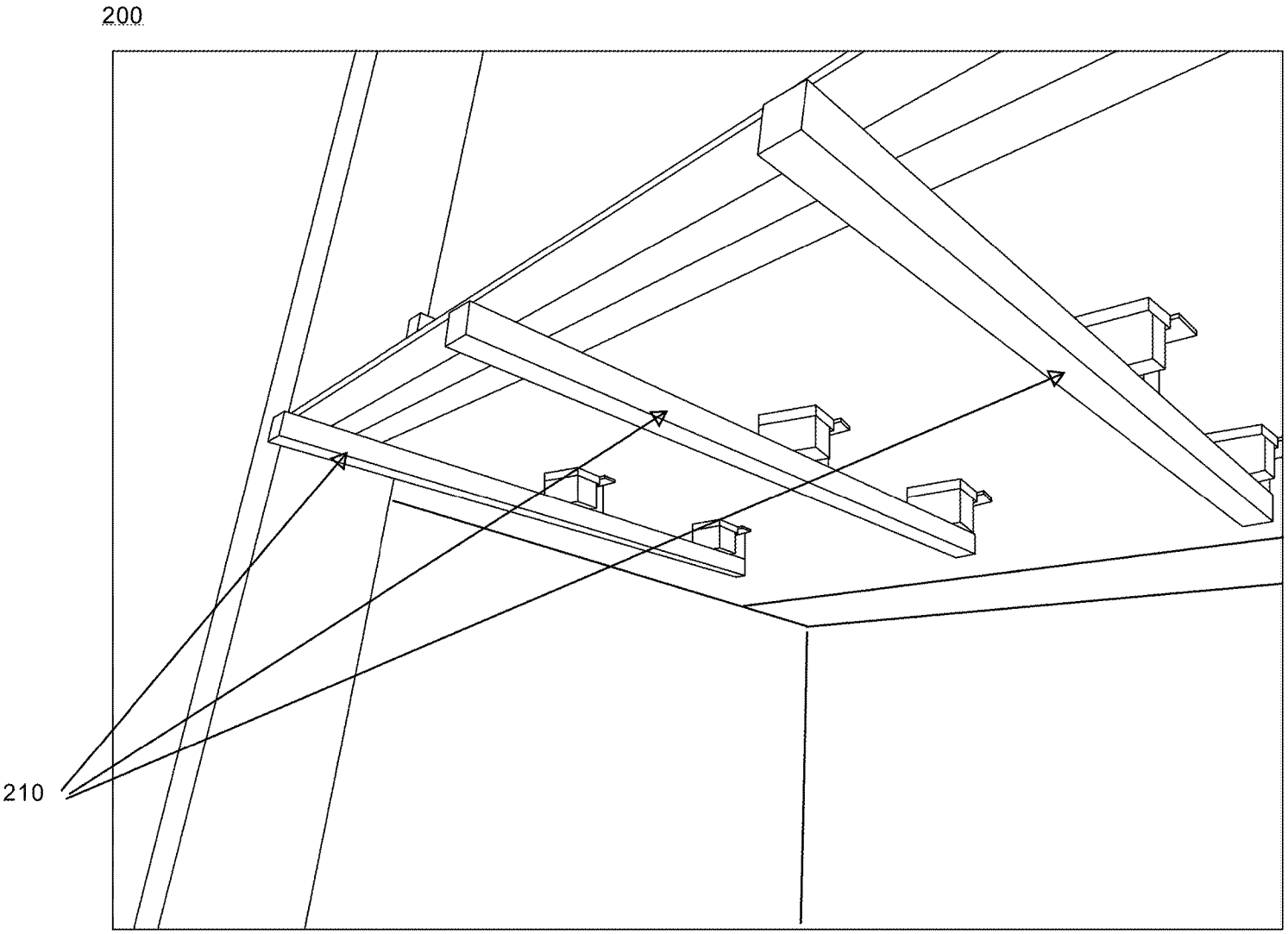
FIG. 6 is another perspective view of the system depicted in FIG. 4, looking up from the bottom front of the edge to be repaired.
Figure 7:
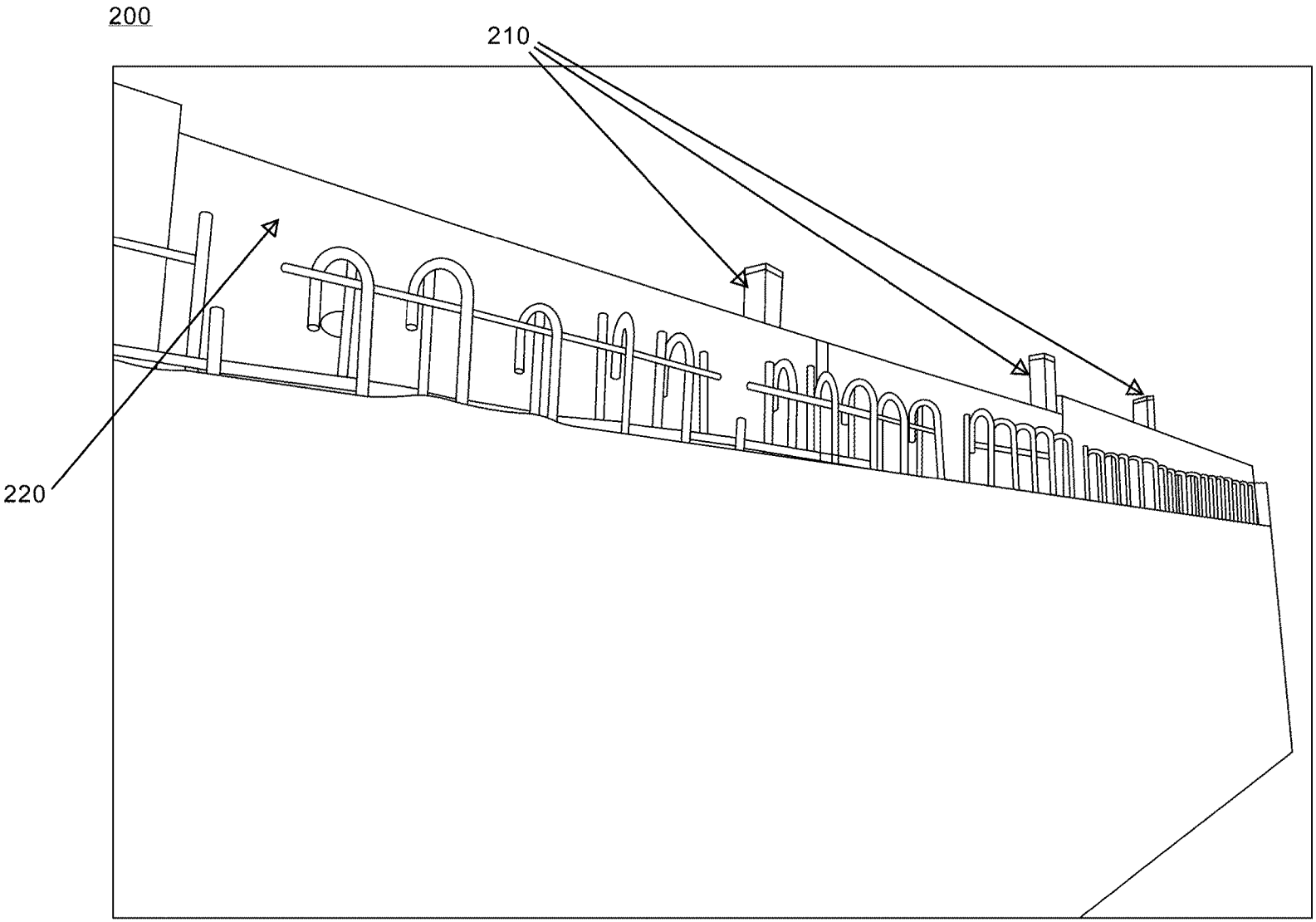
FIG. 7 is another perspective view of the system depicted in FIG. 4, looking down onto the edge to be repaired.

Referring now to the drawings in general and to FIGS. 2 and 3 in particular, a preferred embodiment of the present invention discloses a shoring apparatus 100 that includes a structural member 110, a first set of flanges 120, and a second set of flanges 130. The structural member 110 presents a substantially longitudinal aspect and has a proximal end 140, a distal end 150, and a length 160 extending between the proximal end 140 and the distal end 150. The cross-sectional profile, material, and construction of the structural member is to be chosen based upon the desired application, load requirements, cost limitations, and other factors. By way of example and not limitation, FIGS. 2-3 show a structural member that is a length of tubular steel with a square cross-section. Round cross-sections, I-beams, C-channels, and other appropriate load-bearing cross-sections are contemplated to be within the scope of the present disclosure. Similarly, materials may be chosen according to need. Steel, aluminum, plastics and composites are contemplated to be within the scope of the present disclosure.

Protruding a distance from the structural member 110, are a plurality of attachment structures such as flanges 120 and 130. These attachment structures are configured to attach the shoring apparatus 100 to the underside of the concrete structure to be repaired. This concrete structure is typically a balcony, but could be an overhang, a decorative element, or other concrete structure that is partially or entirely cantilevered and protruding out from a larger structure. This concrete structure has an underside. A form supported on the underside allows for new concrete to be poured above and onto the form. This is then held in place until the newly poured concrete reaches a desired cure or strength, then the form can be removed.

The shoring apparatus 100, then, is configured to support the form at the underside of the concrete structure. As opposed to pole shores, which require a lower surface on which to be supported, the shoring apparatus 100 is configured to be attached to the underside of the concrete structure through the plurality of attachment structures. These attachment structures may be disposed integral to the structural member 110, in embodiments. In the preferred embodiment, however, the attachment structures are flanges 120 and 130 that are fixedly attached to the structural member 110 and protrude perpendicularly away from the structural member 110. As shown in FIGS. 2-3, the first set of flanges 120 and the second set of flanges 130 provide four points of attachment for the shoring apparatus 100 to the concrete structure, thereby providing a larger "footprint" in order to counter any moment forces imparted into the structural member by a load applied adjacent to the distal end 150. The cross-section and material of the flanges 120 and 130 are to be chosen according to the application and need, as discussed above for the structural member 110.

The System 200

Referring to FIGS. 4-7, an embodiment of the present invention is a system 200 for edge repairs of a concrete structure. The system 200 utilizes one or more of the above-described shoring apparatus 210, a one or more form 220 configured to be secured to the concrete structure and disposed between the concrete structure and the one or more shoring apparatus 210, and a one or more spacer beam 230 configured to span the one or more shoring apparatus 210 near the distal end and further configured to be disposed between and in contact with each of the one or more shoring apparatus 210 and the one or more form 220.

The Method 800

Figure 8:
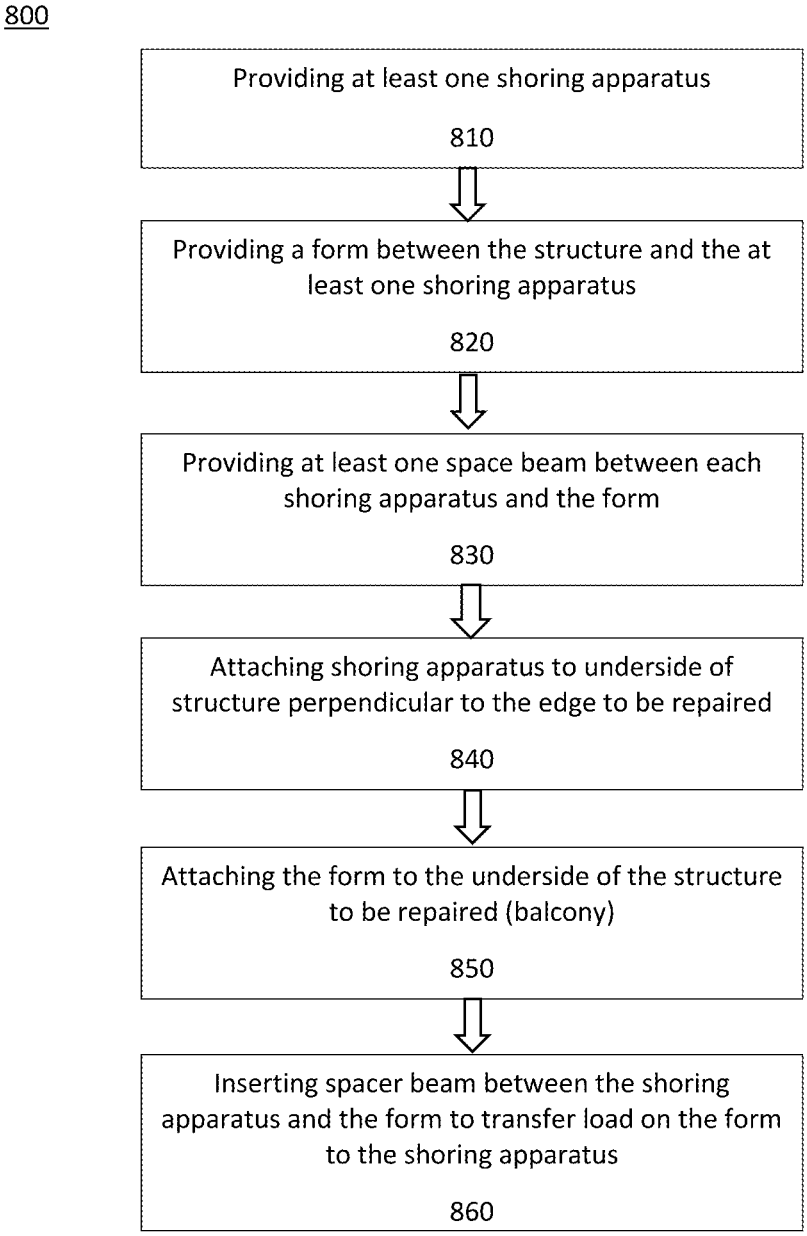
FIG. 8 is an operational flow diagram depicting the method steps according to an embodiment of the present invention.

Referring now to FIG. 8, a method 800 of using a shoring system for edge repairs of a concrete structure is disclosed. Method steps of this embodiment of the invention include:

In step 810, providing a one or more shoring apparatus, the apparatus comprising: a structural member having a proximal end, a distal end, and a length extending between the proximal end and the distal end; a first set of flanges extending from the structural member near the proximal end; and a second set of flanges disposed at a distance from the first set of flanges along the length of the structural member, where the first set of flanges and the second set of flanges are configured such that the apparatus is attachable to the structure and the structural member is of a material, construction, and cross-section that is configured to withstand a specified load applied between the second set of flanges and the proximal end without significant deflection once the apparatus is attached to the structure;

In step 820, providing a one or more form configured to be secured to the structure and disposed between the structure and the one or more shoring apparatus;

In step 830, providing a one or more spacer beam configured to span the one or more shoring apparatus near the distal end and further configured to be disposed between and in contact with each of the one or more shoring apparatus and the one or more form;

In step 840, attaching each of the one or more shoring apparatus, via the first set of flanges and the second set of flanges, to an underside of the structure to be repaired, each of the one or more shoring apparatus disposed where the length between the proximal end and the distal end is substantially perpendicular to the edge to be repaired and further oriented such that the distal end is positioned adjacent to the edge to be repaired;

In step 850, attaching the one or more form to the underside of the structure to be repaired; and In step 860, inserting the one or more spacer beam between each of the one or more shoring apparatus and the one or more form such that a load on the one or more form is transferred to the one or more shoring apparatus, whereby a shoring system is provided for edge repairs of a concrete structure.

In light of the foregoing description, it should be recognized that embodiments in accordance with the present invention can be realized in numerous configurations contemplated to be within the scope and spirit of the claims. Additionally, the description above is intended by way of example only and is not intended to limit the present invention in any way, except as set forth in the claims. Modifications and changes to the invention should be readily apparent to those having ordinary skill in the art, which modifications are intended to be within the spirit and scope of the invention as claimed. It is also understood that the foregoing description is illustrative of the present invention and should not be considered as limiting. Components from one embodiment can be combined with another embodiment and remain within the spirit and scope of the invention. Therefore, other embodiments of the present invention are possible without departing from the spirit and scope of the present invention.

The invention claimed is:

1. A method of using a shoring system for edge repairs of a concrete structure, the method comprising;

providing a one or more shoring apparatus, the apparatus comprising:

a structural member having a proximal end, a distal end, and a length extending between the proximal end and the distal end;

a first set of flanges extending from the structural member near the proximal end; and a second set of flanges disposed at a distance from the first set of flanges along the length of the structural member;

where the first set of flanges and the second set of flanges are configured to attach the apparatus to the concrete structure; and where the structural member is of a material, construction, and cross-section that is configured to withstand a specified load applied between the second set of flanges and the proximal end without significant deflection once the shoring apparatus is attached to the concrete structure;

providing a one or more form configured to be secured to the concrete structure and disposed between the concrete structure and the one or more shoring apparatus;

providing a one or more spacer beam configured to span the one or more shoring apparatus near the distal end and further configured to be disposed between and in contact with each of the one or more shoring apparatus and the one or more form;

attaching each of the one or more shoring apparatus, via the first set of flanges and the second set of flanges, to an underside of the concrete structure to be repaired, each of the one or more shoring apparatus disposed where the length between the proximal end and the distal end is substantially perpendicular to an edge to be repaired and further oriented such that the distal end is positioned adjacent to the edge to be repaired;

attaching the one or more form to the underside of the concrete structure to be repaired; and inserting the one or more spacer beam between each of the one or more shoring apparatus and the one or more form such that a load on the one or more form is transferred to the one or more shoring apparatus;

whereby a shoring system is provided for edge repairs of a concrete structure.

* * * * *